US005515776A

United States Patent [19]

Scheucher et al.

[11] Patent Number: 5,515,776

[45] Date of Patent: May 14, 1996

[54] WORM PRESS WITH TAPERED SHAFT CORE

[75] Inventors: Peter Scheucher, Kumberg; Gerhard Heindler; Walter Schinninger, both of Graz; Gerhard Paier, Krottendorf-Gaisfeld; Peter Mraz, Klosterneuburg, all of Austria

[73] Assignee: Andritz-Patentverwaltungs-Gesellschaft m.b.H., Graz, Austria

[21] Appl. No.: 335,856

[22] PCT Filed: May 14, 1993

[86] PCT No.: PCT/AT93/00084

§ 371 Date: Jan. 4, 1995

§ 102(e) Date: Jan. 4, 1995

[87] PCT Pub. No.: WO93/23238

PCT Pub. Date: Nov. 25, 1993

[30] Foreign Application Priority Data

May 15, 1992 [AT] Austria ..... 996/92

[51] Int. Cl.[6] ..... B30B 9/18

[52] U.S. Cl. ..... 100/112; 100/117; 100/127; 100/148

[58] Field of Search ..... 100/112, 117, 100/126, 127, 147, 148

[56] References Cited

U.S. PATENT DOCUMENTS

| | | | |
|---|---|---|---|
| 1,152,857 | 9/1915 | Stehlin | 100/148 |
| 1,781,250 | 11/1930 | Schwarz | 100/127 |
| 1,835,789 | 12/1931 | Lang | 100/117 |
| 1,851,191 | 3/1932 | Lang | 100/147 |
| 3,394,649 | 7/1968 | Kemper et al. | 100/117 |
| 3,982,483 | 9/1976 | Bird et al. | 100/117 |
| 4,915,830 | 4/1990 | Mackay et al. | 100/117 |

FOREIGN PATENT DOCUMENTS

| | | | |
|---|---|---|---|
| 1005208 | 4/1952 | France | 100/117 |
| 2036597 | 12/1970 | France | 100/127 |
| 147673 | 1/1904 | Germany | 100/117 |
| 472285 | 2/1929 | Germany | 100/117 |
| 992396 | 5/1965 | United Kingdom | 100/112 |

*Primary Examiner*—Stephen F. Gerrity
*Attorney, Agent, or Firm*—Chilton, Alix & Van Kirk

[57] ABSTRACT

The present invention relates to a worm press for separating liquids from solids-liquid mixtures, in particular fibrous suspensions, more particularly under pressure, including a worm rotating inside a jacket comprising liquid passages. The worm press according to the invention is primarily characterized in that the shaft (13) of the worm (14) which is preferably of hollow construction, comprises in the axial conveying direction following onto the region which comprises at least one worm rib (14'), a smooth terminal region (13') in which the worm shaft (13) is designed as a jacket shaft, provided with a cavity (13") between a jacket (22) and a preferably hollow core (17), and that this jacket (22) comprises liquid passages, for example bores (3"), leading into the aforementioned cavity (13"), this cavity (13") being in communication with at least one liquid drainage outlet (18).

16 Claims, 4 Drawing Sheets

WORM PRESS WITH TAPERED SHAFT CORE

BACKGROUND OF THE INVENTION

The present invention relates to a worm press for separating liquids from solids-liquid mixtures, in particular fibrous suspensions, more particularly under pressure, including a worm rotating inside a jacket comprising liquid passages, wherein the shaft of the worm which is preferably of hollow construction, comprises in the axial conveying direction following onto the region which comprises at least one worm rib, a smooth terminal region in which the worm shaft is designed as a jacket shaft, provided with a cavity between a shaft jacket and a preferably hollow shaft core, and that this shaft jacket comprises liquid passages, for example bores, leading into the aforementioned cavity, this cavity being in communication with at least one liquid drainage means.

A worm press of the aforesaid type is already known from U.S. Pat. No. 3,394,649 (Kemper et al). This worm press serves for the dewatering of sludges or cellulose pulp suspensions and comprises a hollow worm shaft having apertures at the end of the pressure zone. Through these bores still further liquid can be drained into the hollow shaft, this liquid draining inside the shaft in a direction opposite to the conveyance direction. However, such a worm press suffers from the disadvantage that only small amounts of liquid can be drained through the bores into the cavity of the shaft. Furthermore, these shafts, when employed for dewatering fibrous suspensions are very susceptible to being blocked by fibres.

SUMMARY OF THE INVENTION

Accordingly, it is an object of the invention to provide a worm press which is of comparatively simple construction, can be operated at higher (squeezing) pressure which moreover permits a drainage of larger amounts of liquid into the cavity of the shaft and where appropriate also reduces the tendency towards blockages by fibres.

This is attained in accordance with the invention in that the cavity in the terminal region of the worm shaft is formed between a shaft core tapering in the axial conveyance direction and which more particularly is hollow and the shaft jacket fitted on the former and provided with liquid passages. Due to this tapering terminal region of the worm shaft a cross-section which is as large as possible is provided for the drainage of the liquid. Due to the tapering of the terminal region of the shaft, the liquid discharge in the axial conveyance direction is made possible whereby the liquid pathways can be kept short.

In accordance with a preferred embodiment of the invention, a conveyed matter retention means, preferably adapted to be regulated is provided in the terminal region of the worm shaft for the purpose of building up pressure in the conveyed material present between the worm and the worm press jacket surrounding it, outside of the shaft jacket, in particular a pivotable retention flap. Due to the pressure build-up, respectively the additional conveyed matter retention means installed in a stationary manner, the material at the end of the worm press is dammed up, thereby being subjected to an increased pressure in that region, and liquid still present in the material being pressed out and discharged through liquid passages in the jacket of the worm shaft into a cavity.

An advantageous embodiment of the invention is characterised in that the shaft core in the terminal region of the worm shaft conically tapers in the axial conveyance direction. In that manner the manufacture and the liquid discharge are facilitated.

According to an advantageous embodiment of the invention the liquid passages in the terminal region of the shaft jacket of the worm shaft are provided in the region of the conveyed material retention means. In that manner the liquid discharge can be readily controlled.

Preferably, according to the invention, the liquid passages in the terminal region of the shaft jacket of the worm shaft have a cross-section which increases towards the cavity between the shaft jacket and the shaft core, i.e. in the direction of discharge of the liquid. The liquid discharge is enhanced thereby.

According to an advantageous embodiment of the invention, partitions fitted to the shaft jacket of the worm shaft are provided in the terminal region, preferably parallel to the longitudinal axis of the worm shaft and arranged in axial planes, which partitions jointly with the shaft jacket and the shaft core form channels for the discharge of the liquid. This permits the attainment of proper liquid flows.

Expediently at the end of the channels an overflow for the liquid is provided. According to a further advantageous embodiment of the invention, rinsing means, preferably spray nozzles, are provided at the end of the channels for cleaning the channels, in particular of entrained fibres.

Preferably, according to the invention, the worm shaft and also the tapering shaft core fitted thereto are hollow, resulting in a desirable weight reduction of the worm press.

BRIEF DESCRIPTION OF THE DRAWINGS

The invention will be elucidated by way of example with reference to the drawings. There is shown in.

DESCRIPTION OF THE PREFERRED EMBODIMENT

In the Figures equal or analogous parts are provided with the same reference numbers: 11 denotes the inlet nipple into the worm chamber, 3 denotes the curved screen of the worm chamber and 4 denotes the supporting body for the screen 3; 13 denotes the shaft, 14' denotes worm fibs on the worm 14, 17 denotes the tapering worm core of the shaft 13; 19, 19' denote partitions, 21 denotes retention flaps, 22 denotes the shaft jacket, 23 denotes passages for discharging the liquid and 12 denotes a chum at the end of the worm press for discharging the dewatered material.

Figure 1:
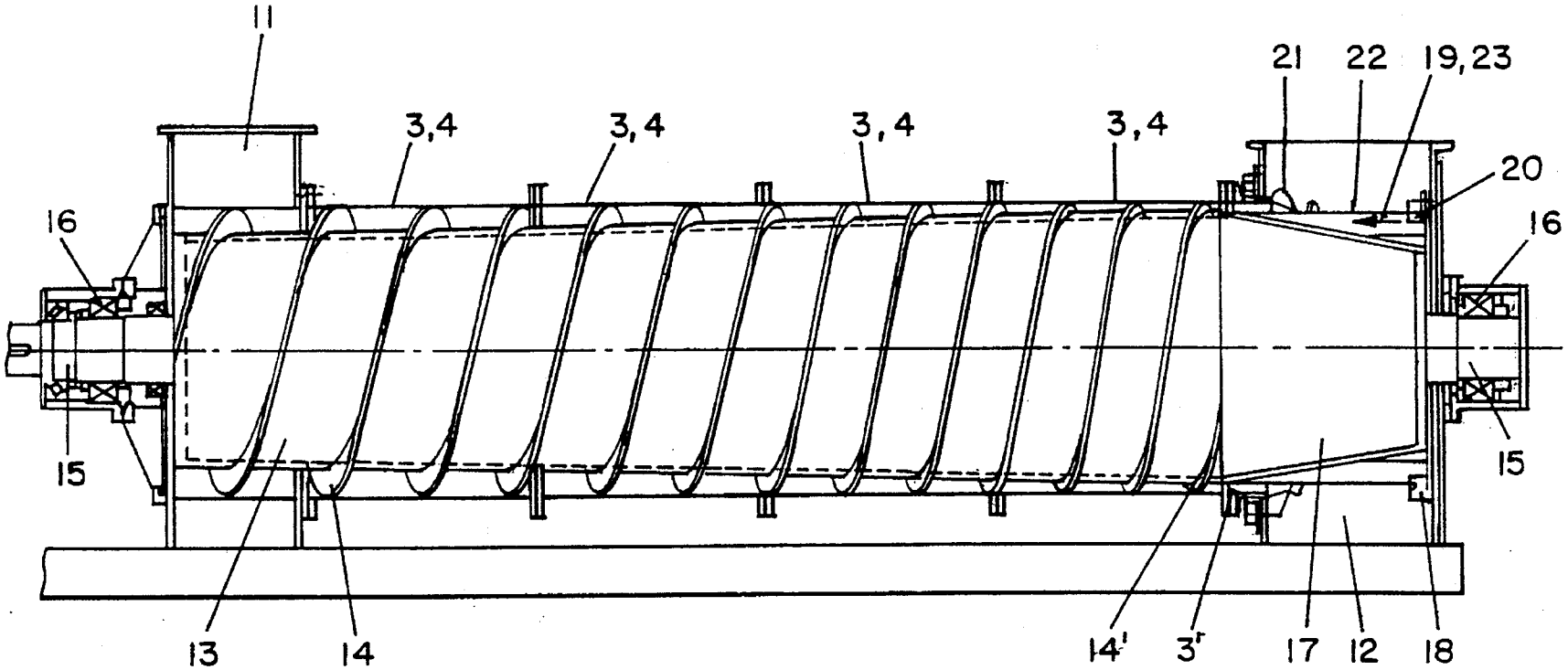
FIG. 1 a longitudinal section through a worm press according to the invention, FIG. 2 a longitudinal section in the terminal region of the worm press, FIG. 3 a cross-sectional segment in the terminal region of the worm press along the plane III—III of FIG. 2 on a smaller scale, and FIG. 4 a cross-sectional segment in the terminal region of the worm press along the plane IV—IV of FIG. 2.
Figure 3:
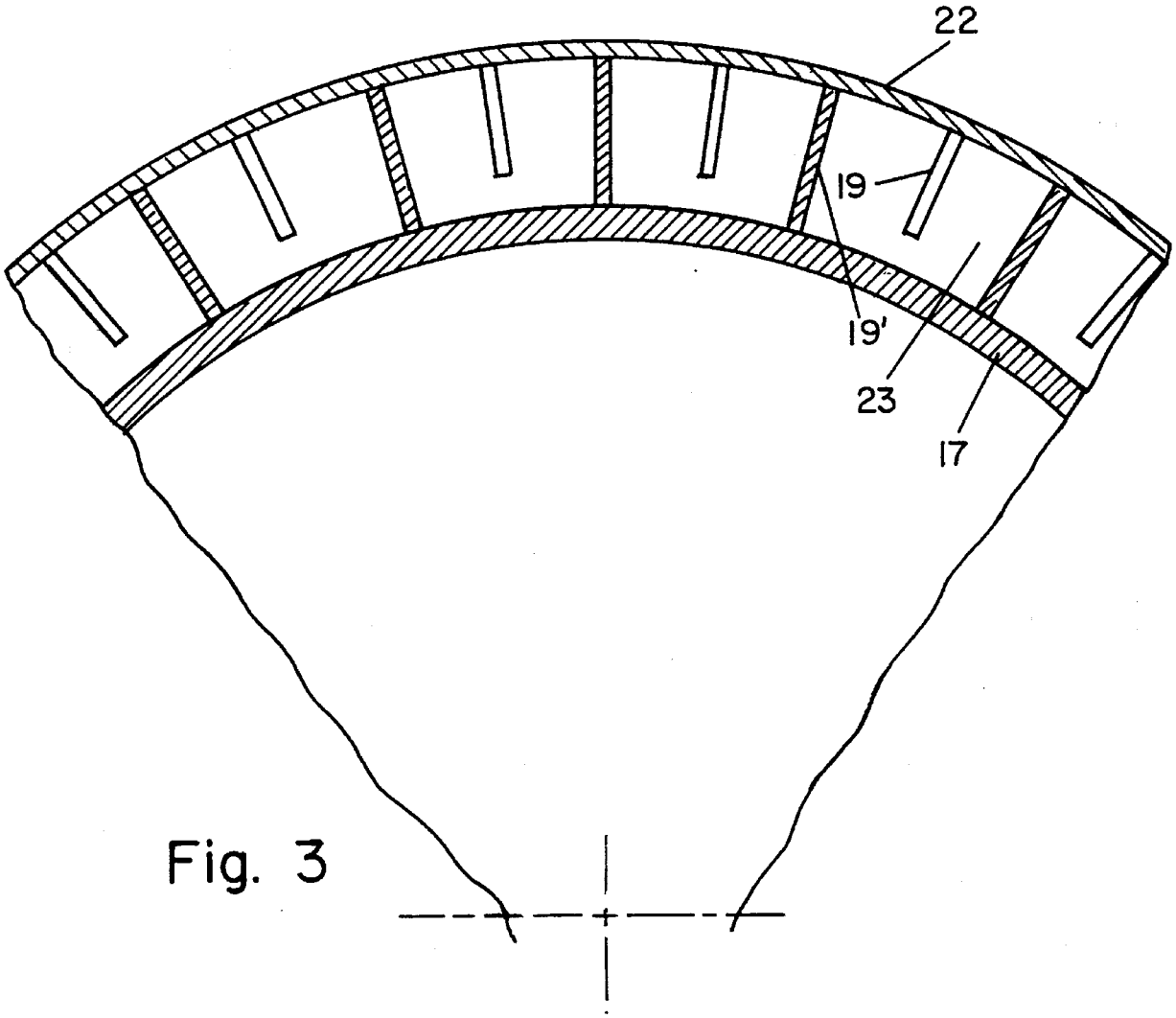

An overall view of the worm press according to the present invention is illustrated in FIG. 1. The fibrous suspension to be dewatered is introduced by way of the inlet nipple 11 into the worm chamber. This chamber is formed, for example of a plurality of successive screens 3 of circular curvature forming the cylinder wall and supporting bodies 4. The worm rib(s) 14' of the worm 14 is/are in this context fixed on a hollow shaft 13. Roller axle pins 15 are fitted to the ends of the shaft 13, by way of which the shaft 13 (including the worm fib(s) 14', of the worm 14) is rotatably mounted in bearings 16. The dewatered material is eventually discharged through a chute 12 from the worm press. The worm shaft 13 comprises in the terminal region of the worm press a conically tapering shaft core 17. As also shown in FIG. 3, the shaft core 17, the partitions 19,19' and the shaft jacket 22, including screen portion 3', jointly form channels 23 for the drainage of the liquid. Finally, the liquid is discharged by way of an overflow 18 from the worm press.

For cleaning the channels 23 rinsing means 20, e.g. spray nozzles are provided. By means thereof cleaning of the channels may proceed even whilst in operation. Previously known embodiments of worm presses often had to be shut down for cleaning purposes and even had to be partly taken apart.

In order to generate or regulate in the terminal region of the worm press the pressure required for the separation of the liquid from the solids suspension, appropriate retention flaps 21 are provided which can be controlled by way of hydraulic cylinders.

Figure 2:
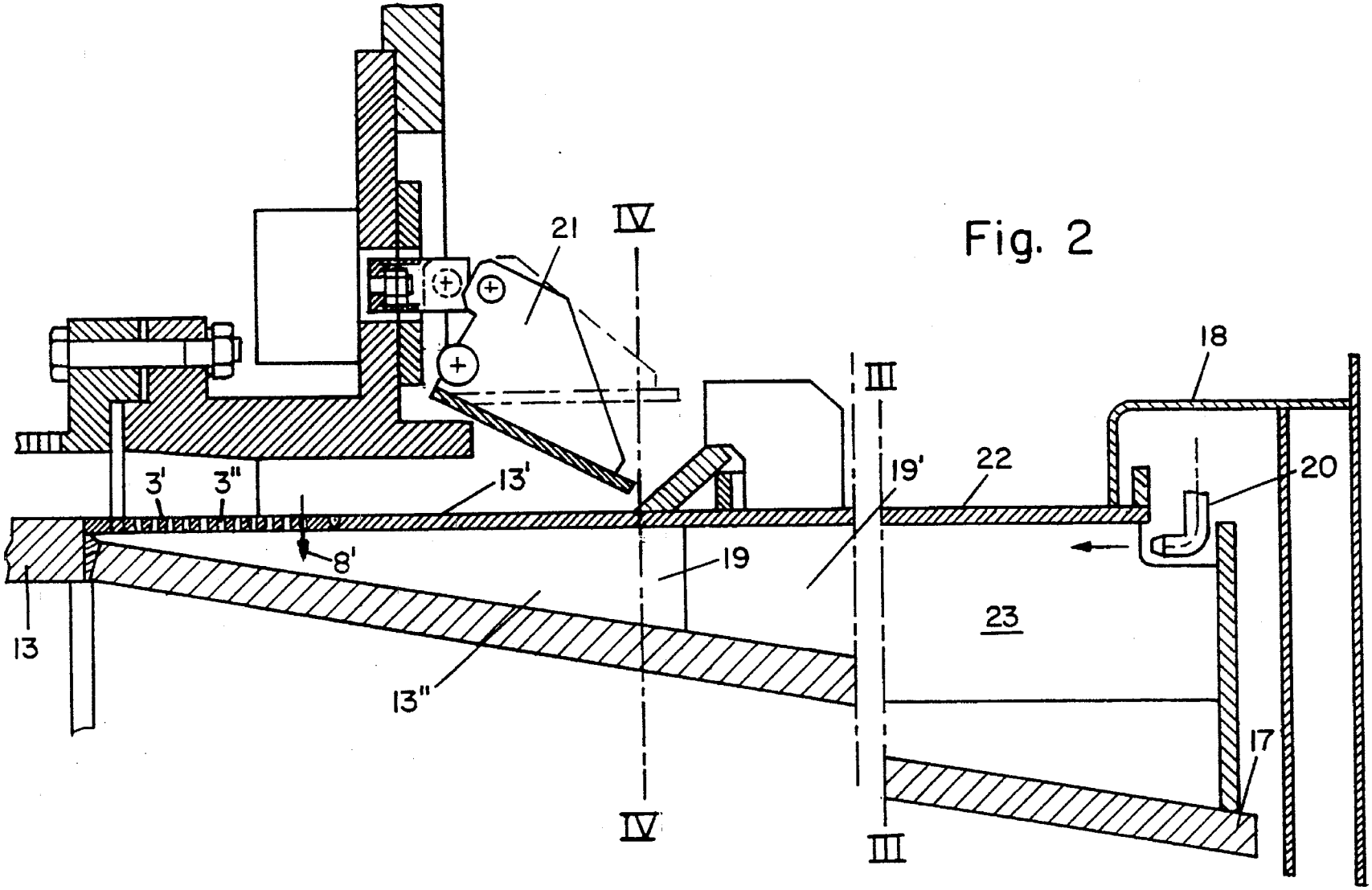

In FIG. 2 a portion of the terminal region of the worm press according to the invention is illustrated in longitudinal section. As also shown in FIG. 3, partitions 19,19' are fitted to the shaft jacket 22 and extend radially inwardly to the shaft core 17, or slightly spaced from the shaft core 17, in the region of the worm shaft which has the conical taper. The partitions 19,19' are substantially planar, and extend in axial planes parallel to the longitudinal axis of the worm shaft 13. The shaft core 17, partitions 19, 19' and shaft jacket 22 or the smooth terminal region 13' and portion 3' of the worm shaft form passages 23 through which the liquid is drained from the worm press, being separated from solid matter after the passage in the drainage direction 8' through the screening section 3' or rather the apertures 3" thereof and through the cavity 13" between the smooth terminal region 13' or section 3' and the shaft core 17. The cavity 13" has a continuously increasing flow cross-section from the apertures 3" to the discharge shute 12. Pressure may be exercised onto the fibrous suspension to be dewatered by means of the controllable retention flap 21.

FIG. 3 shows a cross-sectional segment of the terminal region of the worm press including the individual passages 23 which are formed on the one hand by the walls of the shaft core 17 and the shaft jacket 22 and on the other hand by the partitions 19, 19'.

Figure 4:
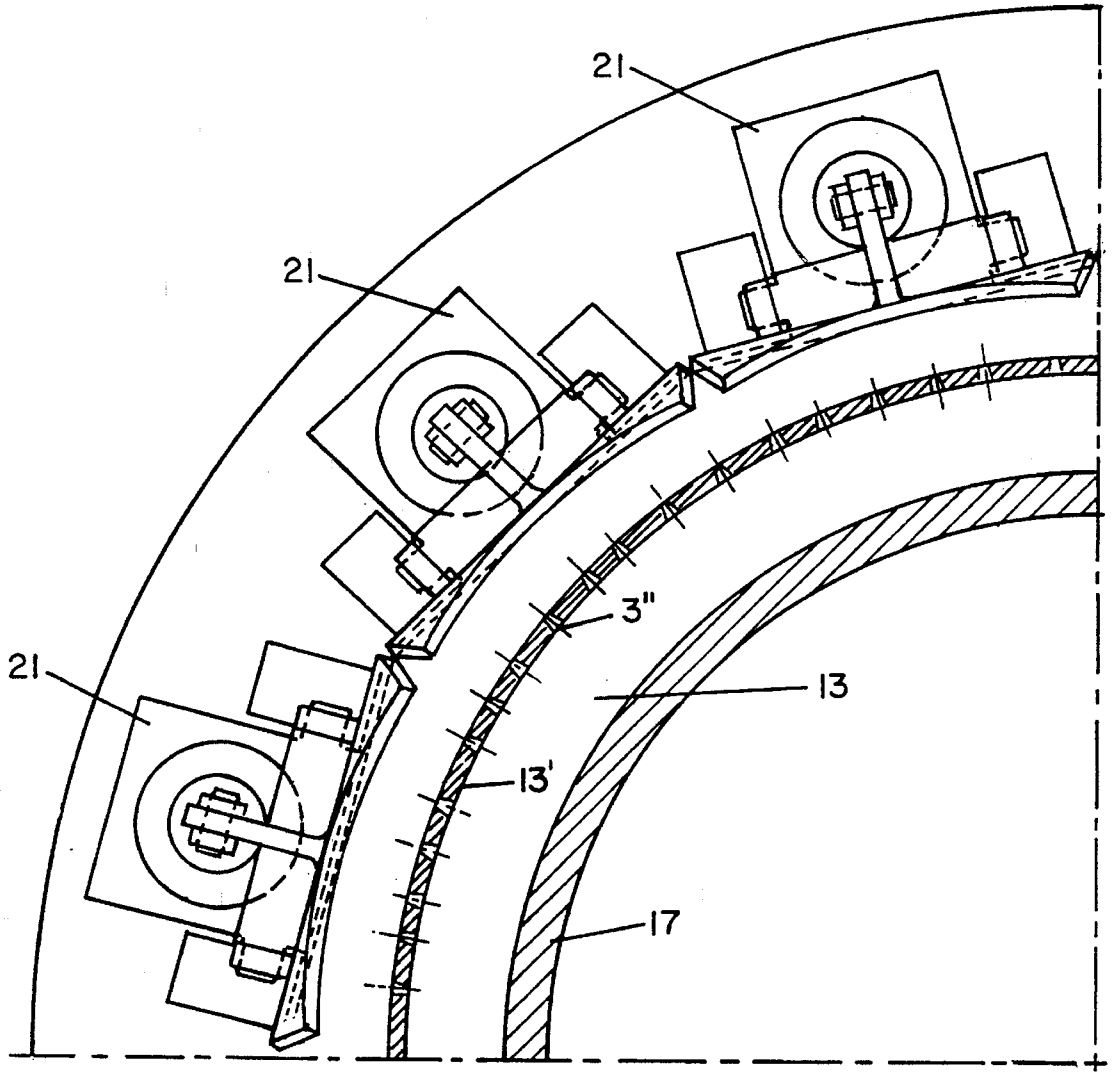

Finally, FIG. 4 shows a cross-sectional segment in the terminal region of the worm press including the retention flaps 21 in the region of the smooth terminal section 13' of the worm shaft for regulating the back pressure or the conveyed material retention such that the material present in this region is subjected to an increased pressure and liquid still present in the material is pressed out and discharges through bores 3" in the shaft jacket into the cavity 13" formed by the smooth terminal region 13' and the tapering shaft core 17.

The embodiments illustrated in the Figures serve for explaining the invention. However, the invention is by no means restricted to these embodiments.

We claim:

1. In a worm press for separating liquids from solids-liquid mixtures, including a worm (14) formed as ribs on a shaft for rotation inside a worm jacket (3) having liquid passages, wherein the shaft (13) of the worm (14) includes in the axial conveying direction following at least one worm rib (14'), a ribless terminal region (13') in which the worm shaft (13) is in the form of a jacket shaft, provided with a cavity (13") between a shaft jacket (22) and a shaft core (17), and this shaft jacket (22) comprises liquid passages (3"), leading into said cavity (13"), said cavity (13") being in fluid communication with at least one liquid drainage means (18), wherein the improvement is characterized in that said cavity (13") is formed in said terminal region (13') of the worm shaft (13), between said shaft core (17), which tapers in the axial conveyance direction, and said shaft jacket (22), which is fitted on the shaft and provided with said liquid passages (3"), thereby defining a continuously increasing flow cross-section in said cavity (13") from the liquid passages (3") to the liquid drainage means.

2. A worm press according to claim 1, wherein material retention means are provided around the terminal region (13') of the worm shaft (13) for building up a back pressure in the conveyed material outside of the shaft jacket (22) at said passages (3") leading into the cavity.

3. A worm press according to claim 2, wherein the liquid passages (3") in the terminal region (13') of the shaft jacket (22) are provided immediately upstream of the retention means (21).

4. A worm press according to claim 3, wherein the liquid passages (3") in the terminal region (13') of the shaft jacket (22) have a cross-section which increases towards the cavity between the shaft jacket (22) and the shaft core (17).

5. A worm press according to claim 2, wherein the shaft core (17) tapers conically in the terminal region of the worm shaft (13) in the axial conveyance direction.

6. A worm press according to claim 2, wherein the material retention means includes a plurality of adjustable, pivotable retention flaps.

7. A worm press according to claim 1 wherein the shaft core (17) tapers conically in the terminal region of the worm shaft (13) in the axial conveyance direction.

8. A worm press according to claim 7, wherein the liquid passages (3") in the terminal region (13') of the shaft jacket (22) are provided immediately upstream of the retention means (21).

9. A worm press according to claim 7, wherein the worm shaft (13) and the tapering shaft core (17) fitted thereto are hollow.

10. A worm press according to claim 1, wherein the liquid passages (3") in the terminal region (13') of the shaft jacket (22) have a cross-section which increases towards the cavity between the shaft jacket (22) and the shaft core (17).

11. A worm press according to claim 10, wherein partitions (19,19') fitted to the shaft jacket (22) are provided in the terminal region (13'), parallel to the longitudinal axis of the worm shaft (13) and arranged in axial planes, which partitions (19,19') jointly with the shaft jacket (22) and the shaft core (17) form channels (23) in the cavity for the discharge of the liquid from the cavity to said liquid drainage means.

12. A worm press according to claim 1, wherein the worm shaft (13) and the tapering shaft core (17) fitted thereto are hollow.

13. In a worm press for separating liquids from solids-liquid mixtures, including a worm (14) formed as ribs on a shaft for rotation inside a worm jacket (3) having liquid passages, wherein the shaft (13) of the worm (14) includes in the axial conveying direction following at least one worm rib (14'), a ribless terminal region (13') in which the worm shaft (13) is in the form of a jacket shaft, provided with a cavity (13") between a shaft jacket (22) and a shaft core (17), and this shaft jacket (22) comprises liquid passages (3"), leading into said cavity (13"), said cavity (13") being in fluid communication with at least one liquid drainage means (18), wherein the improvement is characterized in that said cavity (13") is formed in said terminal region (13') of the worm shaft ( 13), between said shaft core, (17), which tapers in the axial conveyance direction, and said shaft jacket (22), which is fitted on the shaft and provided with said liquid passages (3"), and partitions (19,19') are fitted to the shaft jacket (22) in the terminal region (13'), parallel to the longitudinal axis of the worm shaft (13) and arranged in axial planes, whereby the partitions (19,19') jointly with the shaft jacket (22) and the shaft core (17) form channels (23) in the cavity for the discharge of the liquid from the cavity to said liquid drainage means.

14. A worm press according to claim 13, wherein the liquid drainage means are provided at the axial end of the channels (23).

15. A worm press according to claim 13 wherein rinsing means (20), are provided at the axial end of the channels (23) for cleaning the channels (23) of entrained solids.

16. The worm press according to claim 15, wherein the rinsing means include a plurality of spray nozzles.

* * * * *